US009299546B2

(12) United States Patent
Nikolaev

(10) Patent No.: US 9,299,546 B2
(45) Date of Patent: Mar. 29, 2016

(54) METHODS FOR ACQUIRING AND EVALUATING MASS SPECTRA IN FOURIER TRANSFORM MASS SPECTROMETERS

(71) Applicant: Bruker Daltonik GmbH, Bremen (DE)

(72) Inventor: Evgeny Nikolaev, Moscow (RU)

( * ) Notice: Subject to any disclaimer, the term of this patent is extended or adjusted under 35 U.S.C. 154(b) by 0 days.

(21) Appl. No.: 14/305,676

(22) Filed: Jun. 16, 2014

(65) Prior Publication Data

US 2015/0364304 A1 Dec. 17, 2015

(51) Int. Cl.

| | |
|---|---|
| ***H01J 49/00*** | (2006.01) |
| ***H01J 49/04*** | (2006.01) |
| ***H01J 49/36*** | (2006.01) |
| ***H01J 49/42*** | (2006.01) |

(52) U.S. Cl.

CPC ..... *H01J 49/0036* (2013.01); *H01J 49/0031* (2013.01); *H01J 49/36* (2013.01); *H01J 49/425* (2013.01)

(58) Field of Classification Search

CPC ..... H01J 49/34; H01J 49/36; H01J 49/38; H01J 49/0031; H01J 49/45

See application file for complete search history.

(56) References Cited

U.S. PATENT DOCUMENTS

| | | | | |
|---|---|---|---|---|
| 4,761,545 | A * | 8/1988 | Marshall et al. | 250/291 |
| 5,625,186 | A | 4/1997 | Frankevich et al. | |
| 5,679,950 | A | 10/1997 | Baba et al. | |
| 5,886,346 | A | 3/1999 | Makarov | |
| 6,403,955 | B1 | 6/2002 | Senko | |
| 7,312,441 | B2 * | 12/2007 | Land et al. | 250/282 |
| 7,964,842 | B2 | 6/2011 | Köster et al. | |
| 7,994,473 | B2 | 8/2011 | Köster | |
| 8,704,173 | B2 | 4/2014 | Nikolaev et al. | |
| 8,759,752 | B2 * | 6/2014 | Remes | 250/282 |
| 2003/0042414 | A1 * | 3/2003 | Smith et al. | 250/282 |
| 2007/0176091 | A1 * | 8/2007 | Lange et al. | 250/288 |
| 2008/0067346 | A1 * | 3/2008 | Amster et al. | 250/282 |
| 2008/0203293 | A1 * | 8/2008 | Makarov | 250/283 |
| 2009/0084948 | A1 * | 4/2009 | Baykut et al. | 250/282 |
| 2011/0082658 | A1 * | 4/2011 | Bloomfield et al. | 702/85 |
| 2011/0251801 | A1 * | 10/2011 | Misharin et al. | 702/32 |

(Continued)

OTHER PUBLICATIONS

Hendrickson, Christopher L. et al., Two-Dimensional Coulomb-Induced Frequency Modulation in Fourier Transform Ion Cyclotron Resonance: a Mechanism for Line Broadening at High Mass and for Large Ion Populations, J. Am. Soc. Mass. Spectrom., Dec. 1, 1993, pp. 909-916.

(Continued)

*Primary Examiner* — Nicole Ippolito
*Assistant Examiner* — Sean Luck
(74) *Attorney, Agent, or Firm* — Benoit & Cote, Inc.

(57) ABSTRACT

The invention provides a method for acquiring a mass spectrum with a Fourier transform mass spectrometer, wherein analyte ions and additional reporter ions oscillate at mass specific frequencies in a measuring cell of the frequency mass spectrometer and interact by Coulomb forces; the image current signal induced by the reporter ion is measured; and mass signals of the analyte ions are determined from a sideband signal of the reporter ions in the frequency domain or from the instantaneous frequency of the reporter ions in the time domain.

19 Claims, 7 Drawing Sheets

(56) References Cited

U.S. PATENT DOCUMENTS

| | | | | |
|---|---|---|---|---|
| 2011/0282587 | A1* | 11/2011 | Jones et al. | 702/19 |
| 2012/0049058 | A1* | 3/2012 | Grothe, Jr. | 250/282 |
| 2012/0109537 | A1* | 5/2012 | Makarov | 702/27 |
| 2012/0193529 | A1* | 8/2012 | Nikolaev et al. | 250/282 |
| 2012/0261564 | A1* | 10/2012 | Belov | 250/282 |
| 2012/0261568 | A1* | 10/2012 | Coon et al. | 250/282 |
| 2012/0280118 | A1* | 11/2012 | Decker et al. | 250/282 |
| 2012/0309027 | A1* | 12/2012 | Anderson et al. | 435/7.21 |
| 2013/0043380 | A1* | 2/2013 | Correale | 250/252.1 |
| 2013/0080073 | A1* | 3/2013 | de Corral | 702/23 |
| 2013/0112863 | A1* | 5/2013 | Koster | 250/282 |
| 2014/0070090 | A1* | 3/2014 | Kostyukevich et al. | 250/282 |

OTHER PUBLICATIONS

Mitchell, Dale W. et al., Cyclotron Motion of Two Coulombically Interacting Ion Clouds with Implications to Fourier-transform Ion Cyclotron Resonance Mass Spectrometry, Physical Review E, Oct. 1995, pp. 4366-4386, vol. 52, No. 4, The American Physical Society.

Leach, Franklin E. III et al., Analysis of Phase Dependent Frequency Shifts in Simulated FTMS Transients Using the Filter Diagonalization Method, International Journal of Mass Spectrometry, Jun. 23, 2012, pp. 19-24, vols. 325327, Elsevier B.V.

Shu-Ping Chen et al., Modelling Coulomb Effects in Fourier-transform Ion Cyclotron Resonance Mass Spectrometry by Charged Disks and Charged Cylinders, Rapid Communications in Mass Spectrometry, Apr. 8, 2005, pp. 1-3, vol. 6, Issue 1, John Wiley & Sons, Inc.

* cited by examiner

METHODS FOR ACQUIRING AND EVALUATING MASS SPECTRA IN FOURIER TRANSFORM MASS SPECTROMETERS

BACKGROUND OF THE INVENTION

1. Field of the Invention

The present invention relates to the acquisition and evaluation of mass spectra in Fourier transform (FT) mass spectrometers in which ions oscillate on trajectories at mass specific frequencies and the ion motion is detected as a time-domain signal.

2. Description of the Related Art

Today, the two main classes of Fourier transform mass spectrometers are ion cyclotron resonance (ICR) mass spectrometers and electrostatic Kingdon ion traps with a harmonic potential along a longitudinal direction. In general, FT mass spectrometers comprise a measuring cell in which analyte ions oscillate along one or two spatial dimensions at frequencies being specific to their mass-to-charge ratio. The motion of the oscillating ions is recorded as a time-domain signal, e.g., by measuring the image current induced on detection electrodes of the measuring cell. A mass spectrum or, more generally, separated mass signals are obtained by applying a spectral decomposition, e.g., by a Fourier transform, or a parameter estimation method, e.g., a filter diagonalization method (FDM), to the time-domain signal. The amplitude and frequency of a mass signal relate to the mass-to-charge ratio and abundance of an analyte ion species. A calibration is needed to assign the frequency of a mass signal to a mass-to-charge ratio.

ICR mass spectrometers are based on the cyclotron frequency of ions in a magnetic field. Analyte ions are commonly introduced into an ICR cell and then excited to orbital motion around a longitudinal axis. The orbiting ions induce image currents on detection electrodes of the ICR cell. The image currents are recorded as a time-domain signal ("transient") and converted into a mass spectrum, most often by a Fourier transform. The frequency axis of the mass spectrum can be converted into a mass axis since the cyclotron frequency is inversely proportional to the mass to charge ratio. The analyte ions are trapped radially by the magnetic field and longitudinally by electric potentials along the longitudinal axis of the measuring cell.

FIG. 1A shows a cylindrical ICR cell according to the prior art. The ICR measuring cell comprises two trapping end cap electrodes (11) and (12) which have the form of plane apertured diaphragms. The analyte ions are introduced into the ICR cell through the apertures. Four longitudinal sheath electrodes (13) are arranged between the trapping electrodes (11) and (12) which have the form of parallel sections of the cylindrical surface. Of the four longitudinal electrodes (13), two opposing electrodes serve to excite the ions to cyclotron orbits and the other two serve as detection electrodes to measure the image currents.

FIG. 1B shows a cylindrical ICR cell as disclosed in U.S. Pat. No. 8,704,173 by Nikolaev et al. (Title: "Ion cyclotron resonance measuring cells with harmonic trapping potential"). The twenty-four sheath electrodes (21) to (44) of the cylindrical measuring cell are divided by separating gaps with parabolic shape into eight digon-shaped ((21) to (28)) and sixteen curved triangular sheath electrodes, (29) to (44). Only electrodes (21) to (23) and (29) to (36) are visible in the figure. The ICR cell is closed at both ends by end cap electrodes (20*a*, 20*b*) which have a rotationally hyperbolic form. The aperture in end cap electrode (20*a*) allows for the introduction of analyte ions on the central axis along the magnetic field lines.

A single trapping voltage is applied to the triangular sheath electrodes (29) to (44), and the endcaps (20*a*, 20*b*), generate an axial trapping potential distribution in the interior of the cell. The potential has a parabolic profile in an axial direction for orbiting ions. The digon-electrodes (21) to (28) are either used as excitation electrodes or detection electrodes.

The class of electrostatic Kingdon ion traps with a harmonic potential along a longitudinal direction comprises two different types of traps: orbital-Kingdon traps and the oscillational-Kingdon traps.

Orbital-Kingdon traps are described in U.S. Pat. No. 5,886,346 (Makarov: "Mass spectrometer"), and consist of an outer barrel-like electrode and a coaxial inner spindle-like electrode. Analyte ions orbit around the inner electrode (to which an attracting potential is applied) while they oscillate at the same time along the axis of the inner electrode (longitudinal direction) in a parabolic electric potential.

Oscillational-Kingdon traps are described in U.S. Pat. No. 7,994,473 (Koster: "Mass spectrometer with an electrostatic ion trap"). An oscillational-Kingdon trap can, for example, comprise an outer electrode and two spindle-shaped inner electrodes with ion-attracting potentials applied to each inner electrode. The outer electrode and the inner electrodes are shaped and arranged such that a parabolic electric potential is formed along the axis of the inner electrodes. Analyte ions oscillate transversely in a plane between the two inner electrodes while they oscillate at the same time in the parabolic electric potential.

There is a third class of FT mass spectrometers using RF quadrupole ion traps with detection electrodes for measuring image currents induced by analyte ions which oscillate in the RF ion traps after introduction and excitation. A three-dimensional FT-RF quadrupole ion trap is disclosed in U.S. Pat. No. 5,625,186 (Frankevich et al.: "Non-destructive ion trap mass spectrometer and method"). A linear FT-RF quadrupole ion trap in which analyte ions oscillate between two pole rods is disclosed in U.S. Pat. No. 6,403,955 (Senko: "Linear quadrupole mass spectrometer").

U.S. Pat. No. 5,679,950 (Baba: "Ion trapping mass spectrometry method and apparatus therefor") discloses three-dimensional and linear RF quadrupole ion traps comprising a laser device for generating a cooling laser beam and a photo detector. Analyte ions generated in the ion trap are supplemented by a specific ion species which is trapped concurrently in the RF ion trap. The added ions generate fluorescence of high intensity and are called probe ions. A light beam is introduced into the RF ion trap to excite the probe ions optically whereby the motion of the probe ions is observed. A supplemental AC electric field is applied to the RF ion trap while being scanned in terms of its frequency. When the secular frequency of the analyte ions coincides with the frequency of the AC electric field, the analyte ions oscillate by resonance. The oscillating analyte ions disturb the motion of the probe ions due to Coulomb collision with the probe ions. Changes in the motion of the fluorescent probe ions are detected optically providing a means of determining how the analyte ions oscillate by resonance. Baba refers to this analyzing scheme as fluorescent mass spectrometry.

U.S. Pat. No. 7,964,842 (Köster: "Evaluation of frequency mass spectra") describes methods for evaluating mass spectra acquired with FT mass spectrometers. The methods are directed to detecting and correcting a parameter drift that occurs during recording of a time-domain signal. The detection of the drift can comprise an analysis of a frequency component, i.e., the time-domain signal generated by a single ion species, to determine whether the instantaneous frequency of the frequency component is constant during recording of the time-domain signal. The instantaneous frequency as a function of time can be determined by applying a short-time Fourier transform to the time-domain signal or from other time-frequency representations of the time-domain signal.

SUMMARY OF THE INVENTION

It is an ongoing objective to enhance the mass resolution of FT mass spectrometers and to enhance the sensitivity of the mass spectrometric analysis.

In a first aspect, the invention provides a method for acquiring a mass spectrum of analyte ions with a Fourier transform (FT) mass spectrometer, comprising the steps of: providing the analyte ions and at least one reporter ion in a measuring cell wherein the analyte ions and the at least one reporter ion oscillate at mass specific frequencies in the measuring cell and interact by coulomb forces; recording a time-domain signal of the reporter ion motion; and determining a mass signal of the analyte ions from a sideband signal of the at least one reporter ion in the frequency domain or from the instantaneous frequency of the at least one reporter ion in the time domain. The sideband signal and any modulation of the instantaneous frequency are generated by the interaction between the analyte ions and the at least one reporter ion. Mass signals in the frequency domain, like the sideband signals of the reporter ions, can be obtained by applying a spectral decomposition, e.g., by a Fourier transform, or a parameter estimation method, e.g., a filter diagonalization method (FDM) to the time-domain signal.

Analyte ions and the at least one reporter ion which are concurrently trapped in the measuring cell commonly have the same polarity. When a reporter ion is passing through a cloud of an analyte ion species having the same polarity, the reporter ion is at first decelerated until reaching the center of the cloud and is then accelerated again after passing the center of the ion cloud. The motion of ions in a measuring cell of a FT mass spectrometer is periodic. Therefore, the interaction between analyte ions and the reporter ion periodically modulates the motion of the reporter ion in time and generates sideband signals in addition to the fundamental signal of the reporter ion that is measured in the absence of any analyte ions and thus without modulation.

In FT-ICR mass spectrometers, the angular frequency of the fundamental signal of an ion is the reduced cyclotron frequency $$\omega_+ = \omega_c/2 + \sqrt{(\omega_c/2)^2 - \omega_t^2/2},$$

wherein $\omega_c = q \cdot B/m$ is the angular cyclotron frequency (with q=charge, B=magnetic field strength and m=mass) and $$\omega_t = \sqrt{q \cdot k/m}$$

is the angular frequency of the longitudinal oscillations within the ICR cell (with k as a constant of the longitudinal trapping potential). In electrostatic Kingdon ion traps with a harmonic potential, the angular frequency of the fundamental signal of an ion is the angular frequency of the longitudinal oscillations within the Kingdon trap:

$$\omega_t = \sqrt{q \cdot k/m}.$$

The angular cyclotron frequency $\omega$ is related to frequency f by the definition: $\omega = 2 \cdot \pi \cdot f$.

The modulation frequency $f_M$ by which the reporter ion motion is modulated in time is given by $f_M = |f_R - f_A|$, wherein $f_R$ is the fundamental frequency of the reporter ion and $f_A$ is the frequency of the analyte ions to be determined. The mass-to-charge ratio and fundamental frequency of the reporter ion is typically known. The motion of the reporter ion can be modulated in phase, frequency or amplitude, or in some combination thereof, due to the interaction with analyte ions. In the case of a frequency modulation, sideband signals are generated at frequencies $f_{SB}$: $f_{SB} = f_R \pm n \cdot f_M = f_R \pm n \cdot |f_R - f_A|$ (with n=1, 2, . . . ). Therefore, the frequency of an analyte ion can be determined from the frequencies $f_R$ and $f_{SB}$. In the case of amplitude modulation, sideband signals are generated at frequencies $f_{SB}$: $f_{SB} = f_R \pm f_M = f_R \pm |f_R - f_A|$.

A mass signal in the frequency domain can be described by its position along the frequency axis, or along a mass axis after calibration, and amplitude (peak height). However, a Fourier transform of a time-domain signal provides a complex number for every sampling point in the frequency domain. Therefore, a phase can also be assigned to each sampling point on the frequency axis. Due to the limited duration of the time domain signal, the amplitude of a mass signal in the frequency domain is peak-shaped and extends therefore along a frequency range. A mass signal is therefore more precisely specified in the frequency domain by an amplitude spectrum and a phase spectrum in the frequency range.

In one embodiment, the frequency $f_A$ of an analyte mass signal, i.e., the mass signal of an analyte ion, can be determined by subtracting the frequency $f_{SB1}$ of the first sideband signal of the reporter ion from two times the fundamental frequency of the reporter ion $f_R$: $f_A = 2 \cdot f_R - f_{SB1}$ because $f_{SB1} = f_R + f_M$. The modulation can be a frequency or amplitude modulation. The amplitude of the sideband signal corresponds to the amplitude of the analyte mass signal at frequency $f_A$ and thus is a measure of the abundance of the analyte ions in the measuring cell.

In another embodiment, the time domain signal of the reporter ion is modulated by frequency modulation and the frequency $f_A$ of an analyte mass signal is determined from the frequency $f_{SB2}$ of a second sideband signal and the fundamental frequency $f_R$ by $f_A = (3 \cdot f_R - f_{SB2})/2$ because $f_{SB2} = f_R + 2 \cdot f_M$. The resolution of the mass signal is doubled compared to the mass signal derived from the first sideband signal. The amplitude of the sideband signal corresponds to the amplitude of the analyte mass signal at the frequency $f_A$ and thus is a measure of the abundance of the analyte ions in the measuring cell.

The resolution can be further enhanced by using even higher order sideband signals to determine the mass signals of the analyte ions. The modulation of the reporter ion motion is commonly periodic, but not harmonic. A periodic modulating function comprises a frequency component at frequency $f_M$, but can also have higher frequency components at frequencies $2 \cdot f_M$, $3 \cdot f_M$, $4 \cdot f_M$, etc., wherein the amplitudes of the higher frequency components are given by the Fourier series analysis. The higher frequency components of the modulating function generate additional series of sideband signals whose analysis enables determining the mass signals of analyte ions at higher resolution compared to mass signals at the fundamental frequencies $f_A$.

In another embodiment the reporter ion motion is modulated in frequency. The instantaneous frequency is a function of time and defined as the temporal derivative of the phase of an oscillating function in the time domain, i.e., a function of time which shows how the carrier frequency of the function changes with respect to time. The instantaneous frequency of the reporter ions can be determined from a time-frequency representation of the recorded time-domain signal, e.g., from a short-time Fourier transform, and the frequency $f_A$ is determined from a spectral decomposition of the instantaneous frequency. The time-domain signal of the reporter ions whose motion is temporally modulated in frequency can be described in a first approximation as follows: $s_R(t)=\sin(2\cdot\pi\cdot f_R\cdot t+\eta\cdot\sin(2\cdot\pi\cdot f_M\cdot t))$. The instantaneous frequency is then given by $f(t)=f_R+\eta\cdot 2\cdot\pi\cdot f_M\cdot\cos(2\cdot\pi\cdot f_M\cdot t)$ from which $f_R$, $f_M$ and thus $f_A$ can be determined, for example, by a Fourier transform. The amplitude of the mass signal is related to the frequency deviation $\eta$ because $\eta$ depends on the total charge of the analyte ions and thus on the abundance of the analyte ions. If the modulating function is not a pure sine wave, the instantaneous frequency f(t) comprises higher frequency components which again allow determining mass signals at higher resolution. In case of an amplitude modulation, the mass signal can be determined from frequency components of the instantaneous amplitude A(t) of the reporter ion signal which can be also determined from a time-frequency representation.

The time-domain signal can be detected as a time transient of the image current induced by the reporter ions on detection electrodes of the measuring cell. In this case, the recorded time-domain signal is most commonly a superposition of the time domain signal of the analyte ions and the reporter ion motion. If the frequency of the reporter ion is sufficiently higher than the frequencies of any analyte ions, the recorded image current signal can be filtered by electronic means such that the filtered time domain signal does not substantially comprise signals at the fundamental frequency of analyte ions. If the total charge of the reporter ions is sufficiently high to be detected by measuring image current, sideband signals or frequency components of the instantaneous frequency can even be measured if the total charge of the analyte ions is not sufficiently high to be detected by measuring an image current. However, the reporter ion can comprise an optically detectable moiety enabling the reporter ion motion to be recorded by optical means. In the latter case, the recorded time-domain signal can be independent of the analyte ion motion because the analyte ions do not comprise the optically detectable moiety. In the optical detection mode, detection electrodes are no longer needed, which can give a higher degree of freedom for the design of the measuring cells. The optically detectable moiety can be a fluorescence label. However, the reporter ion itself can be the ion of a dye.

The method according to the invention can be applied to different types of frequency mass spectrometers, like ion cyclotron resonance mass spectrometers (ICR), electrostatic Kingdon ion traps with a harmonic potential along a longitudinal direction and RF-ion traps (linear or Paul-type). If the FT mass spectrometer is an ion cyclotron resonance mass spectrometer, analyte ions and reporter ions are introduced into the ICR cell and then excited to a cyclotron orbit of substantially the same radius in order to enhance the coulomb interaction between them. If the FT mass spectrometer is an orbital-Kingdon ion trap, analyte ions and reporter ions are preferably introduced into the orbital Kingdon ion trap such that the analyte ions and reporter ions orbit around a central electrode at substantially the same radius while oscillating in the longitudinal direction in the harmonic potential.

The at least one reporter ion can be one single ion or an ion species with multiple ions of the same mass-to-charge ratio. However, more than one reporter ion species can also be provided in the measuring cell of the FT mass spectrometer wherein the reporter ion species have different mass-to-charge ratios. The reporter ions being present in the measuring cell are preferably either positively or negatively charged. A single reporter ion can be a highly charged ion of an organic molecule which is, for example, protonated or de-protonated by electrospray ionization. The charge state of a single reporter ion is preferably higher than ten, most preferably higher than thirty or even higher than fifty. The reporter ions can be singly or multiply ionized atomic species, like $Cs^+$, $Cs^{2+}$, $Fe^+$, $Fe^{2+}$, or negatively charged atomic or molecular species, like $Cl^-$, $SF_6^-$ or $SO_2^-$.

The analyte ions can comprise multiple ion species with different mass-to-charge ratios. The mass specific frequency of the reporter ion may be higher or lower than the mass specific frequency of any analyte ion species. In one embodiment, the frequency of the reporter ion is two times, five times or even ten times higher than the frequency of any analyte ion species.

In a second aspect, the invention provides a parameter estimation method for determining frequencies and amplitudes of analyte ion species in a time-domain signal acquired with a FT mass spectrometer. The basis functions used in the parameter estimation method comprise at least one interaction term which incorporates the modulation of the time-domain signals of the analyte ion species. The modulation is a result of the coulomb interaction between different analyte ion species while the time-domain signal is acquired. The parameter estimation method can, for example, be linear prediction, the Prony method or the filter diagonalization method.

In one embodiment, the instantaneous frequency of a time-domain signal of at least one analyte ion species is determined from a time-frequency representation of the time-domain signal and tested to determine whether a modulation in phase, frequency and/or amplitude is present. A known modulation is used to adjust the interaction term.

In another embodiment, the acquired time-domain signal comprises a time-domain signal of at least one reporter ion species. The frequency-domain signal of the reporter ion species is tested for the presence of sideband signals. If sideband signals are present, they are used to adjust the interaction term.

In yet another embodiment, the interaction term is iteratively adjusted. Therefore, the parameter estimation method is preferably at first applied to the time-domain signal with basis functions which do not comprise any interaction terms. Then, the frequencies and amplitudes of analyte ion species determined by parameter estimation are used to adjust the interaction term for a subsequent parameter estimation.

These and other objects, features and advantages of the present invention will become more apparent in light of the following detailed description of preferred embodiments thereof, as illustrated in the accompanying drawings.

BRIEF DESCRIPTION OF THE DRAWINGS

FIG. 4A shows a mass spectrum comprising mass signals of the analyte and reporter ion species at frequencies $f_{A1}$, $f_{A2}$ and $f_R$ as well as signals of the first sideband SB1 at frequencies $f_{SB1,1}$ and $f_{SB1,2}$. FIG. 4B shows a mass spectrum comprising mass signals of the analyte and reporter ion species at frequencies $f_{A1}$, $f_{A2}$, and $f_R$ as well as signals of the second sideband SB2 at frequencies $f_{SB2,1}$ and $f_{SB2,2}$.

DETAILED DESCRIPTION OF THE INVENTION

Figure 1A:
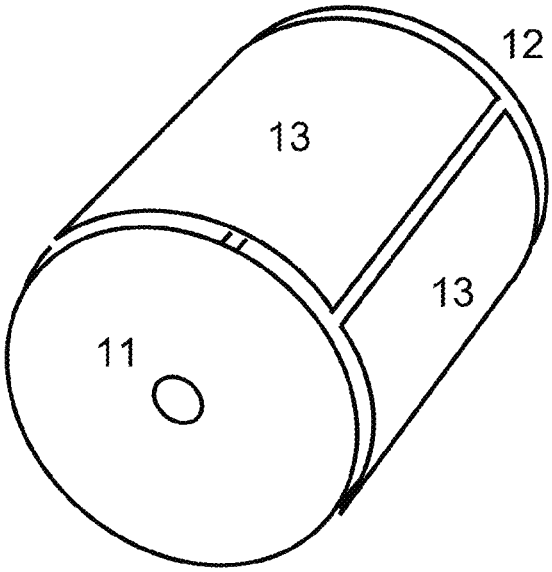
FIGURE 1A (PRIOR ART)
FIGS. 1A and 1B show ICR measuring cells according to the prior art.

In the drawings that follow, unless stated to the contrary, identical reference characters identify similar steps or elements with similar meaning.

Instead of the statutory "unified atomic mass unit" (u), this document uses the "dalton", which was added in the last (eighth) edition of the document "The International System of Units (SI)" of the "Bureau International des Poids et Mesures" in 2006 on an equal footing with the atomic mass unit; as is noted there, this was done primarily in order to use the units kilodalton, millidalton and similar.

In mass spectrometry, it is not the mass of the analyzed ions which is determined, but the mass-to-charge ratio m/z, where m is the physical mass and z the number of not compensated elementary charges of the ions.

Figure 1B:
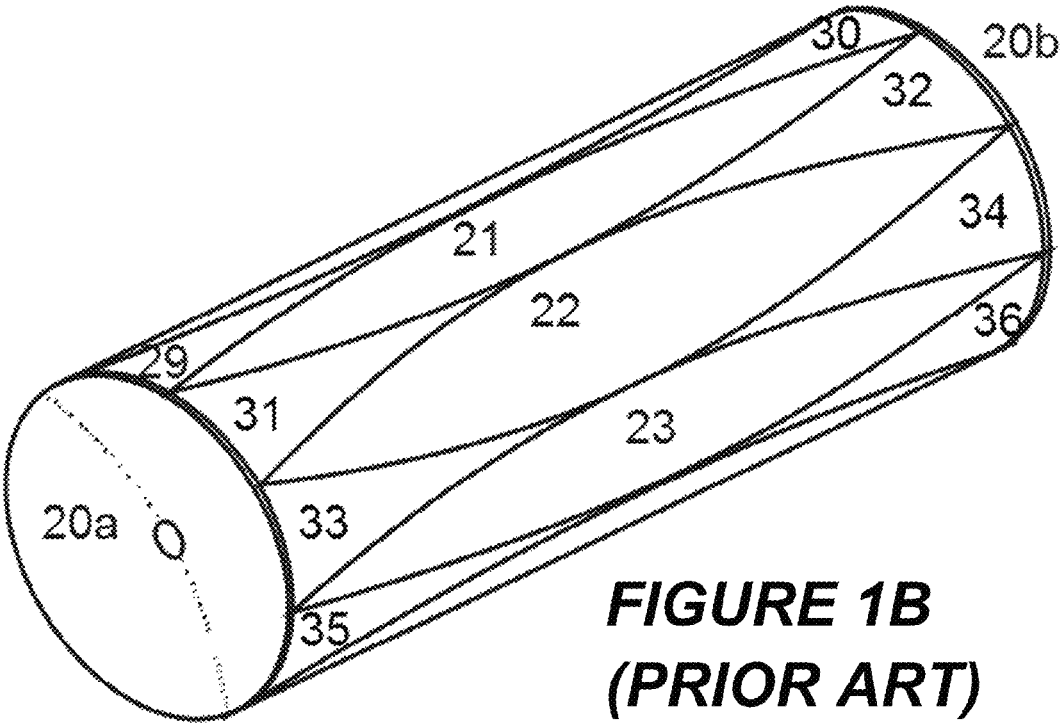
FIGURE 1B (PRIOR ART)
Figure 2:
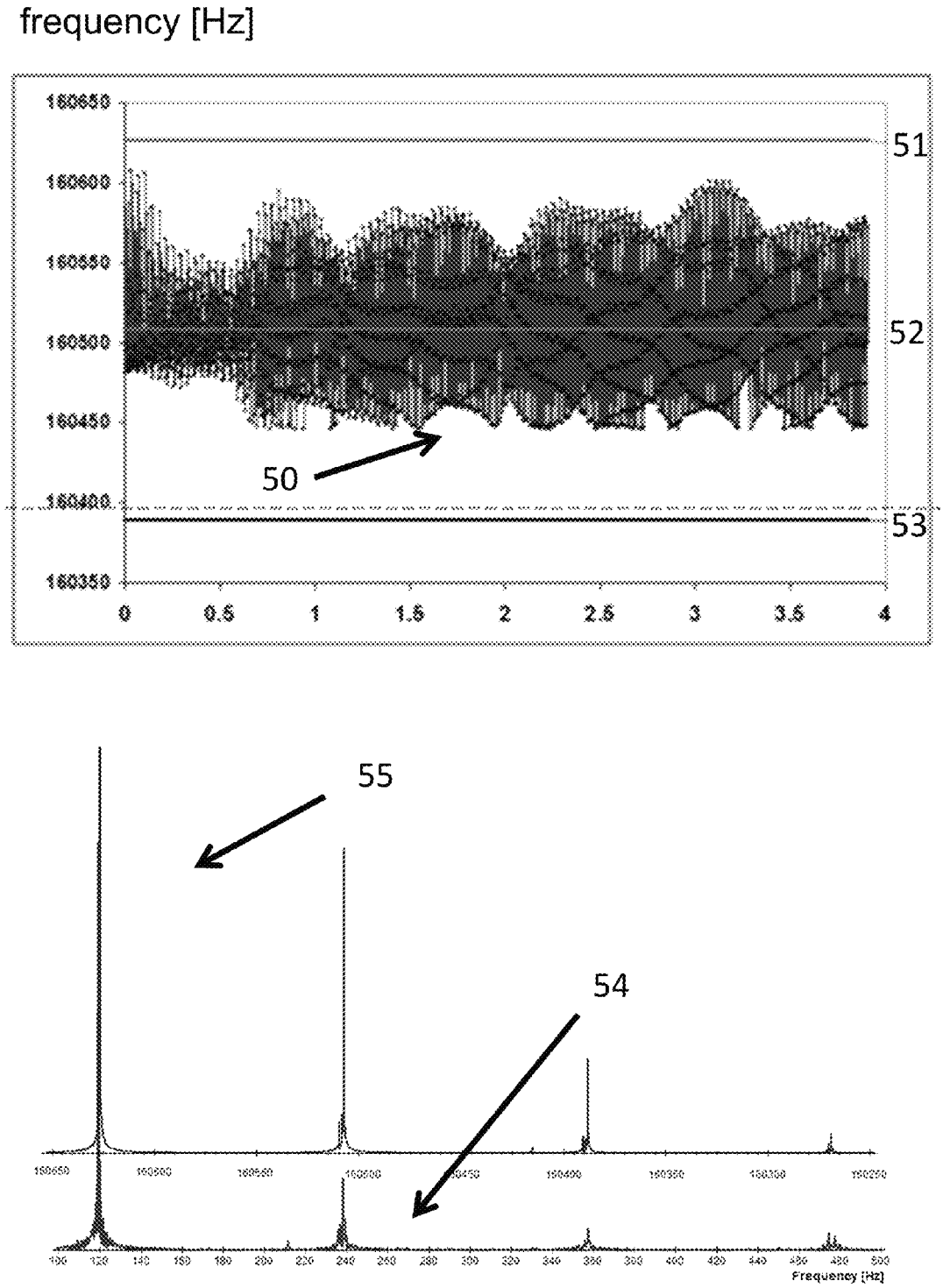
FIG. 2 shows instantaneous frequency (50) derived from a short-time Fourier transform of a time-domain signal acquired for doubly protonated substance P ($C_{63}H_{98}N_{18}O_{13}S_1$+2H) in an ICR measuring cell shown in FIG. 1B and the Fourier transform of the instantaneous frequency (54) compared with the Fourier transform of the acquired time-domain signal (55).

FIG. 2 shows instantaneous frequency (50) derived from a short-time Fourier transform of a time-domain signal acquired for doubly protonated substance P ($C_{63}H_{98}N_{18}O_{13}S_1$+2H) with a FT-ICR mass spectrometer. The substance P is protonated in an electrospray ion source. The ions of the isotopic pattern of the doubly-protonated charge state are isolated in a quadrupole filter and introduced in an ICR measuring cell such as that shown in FIG. 1B. After excitation, the image current induced by the ions of the isotopic pattern is recorded over two seconds as a time-domain signal. Theoretically, three mass signals (51, 52, 53) are expected in the frequency range between 160350 Hz and 160650 Hz. A short-time Fourier transform signal as described in U.S. Pat. No. 7,964,842 or a filter diagonalization method is applied to the recorded time-domain in order to determine the instantaneous frequency (50). The instantaneous frequency (50) corresponds to the temporal behavior of the peak positions during recording of the time-domain signal. However, the short-time Fourier transform of the recorded time-domain signal reveals that the instantaneous frequency (50) is strongly modulated. The temporal modulation of the frequency is a result of Coulomb interaction between ions present in the ICR cell. A spectral decomposition, e.g. a Fourier transform, is applied to the instantaneous frequency (50) which gives mass signals (54). The mass signals correspond to mass signals of a Fourier transform directly applied to the recorded time-domain signal.

Figure 3:
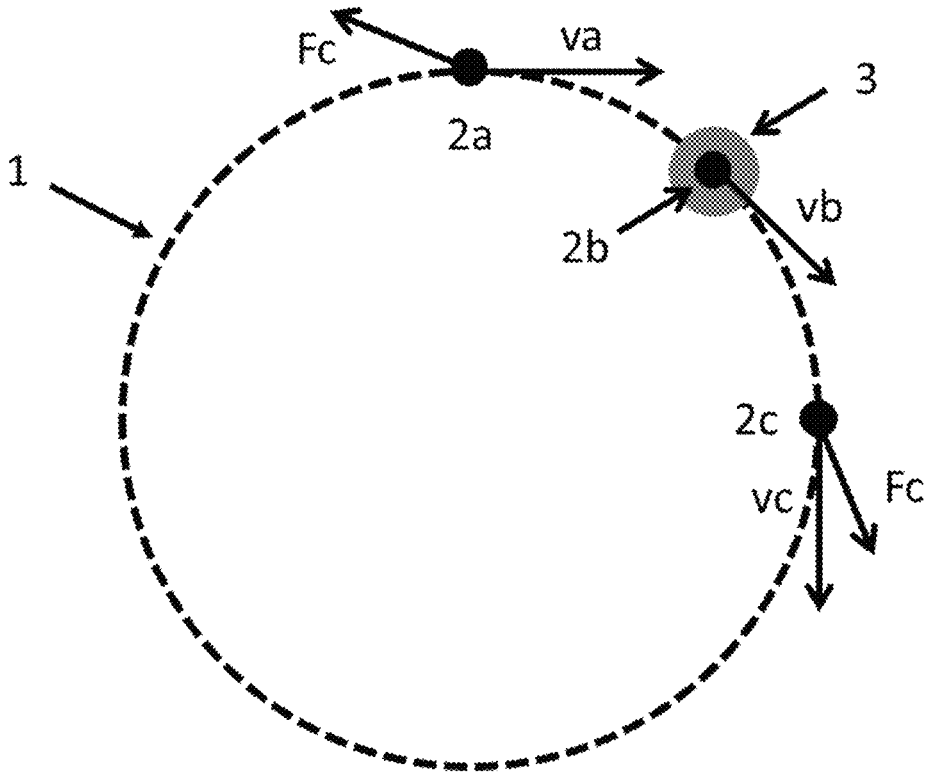
FIG. 3 is a schematic of the interaction between a reporter ion species (2) and an analyte ion species (3) in an ICR cell after reporter ions (2) and analyte ions (3) have been excited to the same cyclotron orbit (1). The interaction results in a frequency modulation of the reporter ion motion.

FIG. 3 is a schematic of the interaction between a reporter ion species (shown at three positions 2*a*, 2*b* and 2*c*) and an analyte ion species (3) in an ICR cell after the reporter ions (2) and the analyte ions (3) have been excited to the same cyclotron orbit (1). Here, the angular frequency of the reporter ion species (2) is much higher than the angular frequency of the analyte ion species (3). Therefore, the position of the analyte ion species (3) does substantially not change during the interaction with the reporter ions species (2).

The reporter ions species (2) and the analyte ions species (3) have the same polarity. When the reporter ions species (2*a*) approaches the analyte ions cloud (3), a repelling Coulomb force $F_c$ acts on the reporter ions species (2*a*) which decelerates the reporter ion species (2*a*). The spatial distribution of the analyte ion species (3) can be approximated as a homogeneously charged sphere whose electric potential V is given by: $V(r)=Q/(8\cdot\pi\cdot\epsilon_o\cdot R_A)\cdot(3-r^2/R^2)$, wherein r is the distance from the center of the analyte ion cloud (3), $R_A$ is the radius of the analyte ion cloud (3), Q is the total charge in the analyte ion cloud (3), and $\epsilon_o$ is the permittivity of free space. Prior to the interaction, the reporter ion species (2*a*) has an initial velocity $v_a=2\cdot\pi\cdot R\cdot f_R$ wherein R is the radius of the orbit (1) and $f_R$ is the fundamental frequency of the reporter ion species (2). The initial velocity $v_a$ is reduced by the repelling electric potential of the analyte ion cloud (3) until the reporter ions species (2*b*) reaches the center of the analyte ion cloud (3). With the electric potential V(r) of the homogeneously charged sphere, the reduced velocity $v_b$ of the reporter ion species (2*b*) at the center of the analyte ion cloud (3) can be calculated as:

$$v_b = \sqrt{v_a^2 - 2\cdot q/m_R\cdot V(r=0)},$$

wherein q is the charge of a single reporter ion, $m_R$ is the mass of the reporter ion and V(r=0) is the electric potential at the center of the analyte ion species (3). After passing the center, the reporter ion species (2*c*) is accelerated by the repelling Coulomb force $F_c$ to the velocity $v_c$ being equal to the initial velocity $v_a$.

Since the reporter ion species (2) and the analyte ion species (3) are excited to the same cyclotron orbit (1), the interaction between both ion species has an effect on the velocity of the reporter ion species (2), but substantially not on the radius of the reporter ion species (2). The velocity of the reporter ion species (2) is proportional to its angular frequency whereas the radius is related to the signal height of the image current induced by the reporter ion species at detection electrodes of the ICR cell (not shown in FIG. 3). Therefore, the interaction shown in FIG. 3 results in a frequency modulation of the reporter ion motion. The frequency deviation Δf generated by the interaction can be determined from the initial velocity $v_a$ and the reduced velocity $v_b$ as following: $\Delta f/f_R=\Delta v/v_a=(v_a-v_b)/v_a$. For a reporter ion carrying a single charge which is excited to cyclotron radius of 1 cm and which has a fundamental frequency $f_R$ of 1 MHz, the frequency deviation $\Delta f$ is about 0.1 Hz at a total charge of 200 elemental charges in the analyte ion cloud (3).

If the modulating function is a single sine wave with frequency $f_M$, the time-domain signal of the reporter ion motion being modulated in frequency is described by $s(t)=\sin(2\cdot\pi\cdot f_R\cdot t+\Delta f/f_M\cdot\sin(2\cdot\pi\cdot f_M\cdot t))$. Then, the frequency modulation of the reporter ion motion generates sideband signals in the frequency domain at frequencies $f_{SB}=f_R\pm n\cdot f_M$, wherein n is the order of the sideband. The amplitudes of the sideband signals $A_{SB}$ can be calculated using Bessel functions J of the first kind, as a function of the sideband number n and the modulation index $\Delta f/f_M$:

$$A_{SB}(f_R\pm n\cdot f_M)=J_n(2\cdot\pi\cdot\Delta f/f_M).$$

Figure 4A:
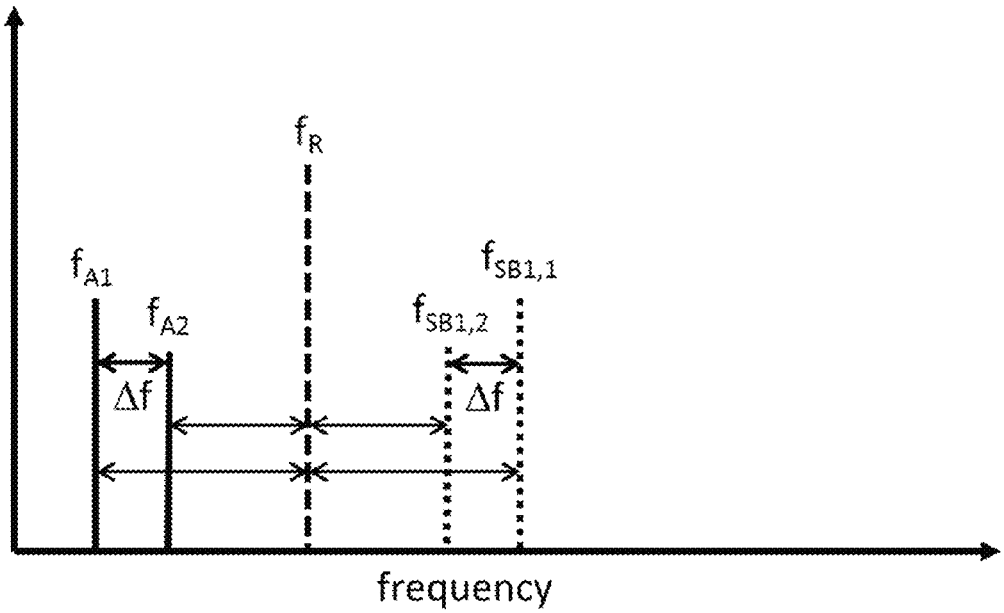
FIGS. 4A and 4B show schematic mass spectra of a reporter ion species R whose motion is frequency modulated by analyte ion species A1 and A2.
Figure 4B:
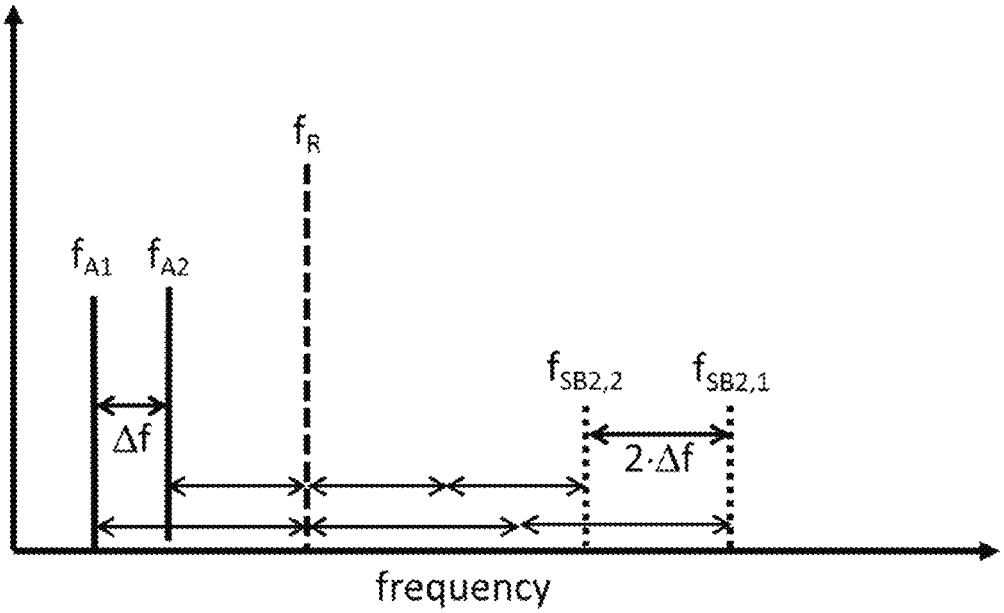

FIGS. 4A and 4B show schematic mass spectra of a reporter ion species R whose motion is frequency modulated by analyte ion species A1 and A2. FIG. 4A shows a mass spectrum comprising mass signals of the analyte and reporter ions species at frequencies $f_{A1}$, $f_{A2}$, and $f_R$ as well as signals (SB1) of first sideband at frequencies $f_{SB1,1}$ and $f_{SB1,2}$. The fundamental frequency $f_R$ of the reporter ion species is greater than the frequencies $f_{A1}$ and $f_{A2}$ of the two analyte species. The mass signal at frequency $f_{SB1,1}$ relates to the modulation of the reporter ion motion by the analyte ion species A1 and is spaced from the fundamental frequency of the reporter ion species by $f_R$-$f_{A1}$. The mass signal at frequency $f_{SB1,2}$ relates to the modulation of the reporter ion motion by the analyte ion species A2 and is spaced from the fundamental frequency of the reporter ion species by $f_R$-$f_{A2}$. It is notable that the order of the fundamental frequencies of the analyte ion species is reversed at the sideband signals, i.e., that $f_{A1}$ is smaller than $f_{A2}$, but that $f_{SB1,1}$ is greater than $f_{SB1,2}$. The spacing between the fundamental frequencies of the analyte ion species is equal to the spacing of the sideband signals. Therefore, mass resolution is not enhanced when the mass signals are determined from signals of the first sideband. FIG. 4B shows a mass spectrum comprising mass signals of the analyte and reporter ion species at frequencies $f_{A1}$, $f_{A2}$ and $f_R$ as well as signals (SB2) of the second sideband at frequencies $f_{SB2,1}$ and $f_{SB2,2}$. Here, the spacing between the sideband signals is twice the spacing of fundamental frequencies of the analyte ion species, which leads to a doubled mass resolution.

Figure 5A:
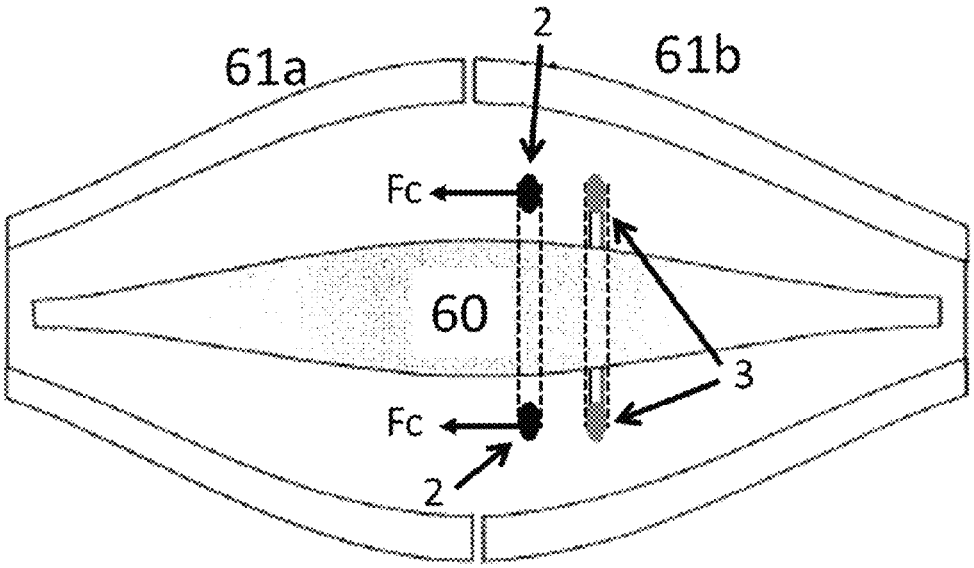
FIG. 5A is a schematic of the interaction between a reporter ion species (2) and an analyte ion species (3) in a measuring cell of an orbital-Kingdon trap comprising an inner electrode (60) and a split outer electrode (61*a*, 61*b*).

FIG. 5A is a schematic of the interaction between a reporter ion species (2) and an analyte ion species (3) in a measuring cell of an orbital-Kingdon trap comprising an inner electrode (60) and a split outer electrode (61*a*, 61*b*). The reporter ions (2) and the analyte ions (3) are injected into the cell and spread into rings which oscillate along the inner electrode (40) at the same radial distance from the inner electrode (60). The image current induced between the electrodes (61*a*) and (61*b*) is recorded as a time-domain signal. Due to the different kind of motion compared to the ions in an ICR cell, the reporter ion motion is at least in part modulated in amplitude.

Figure 5B:
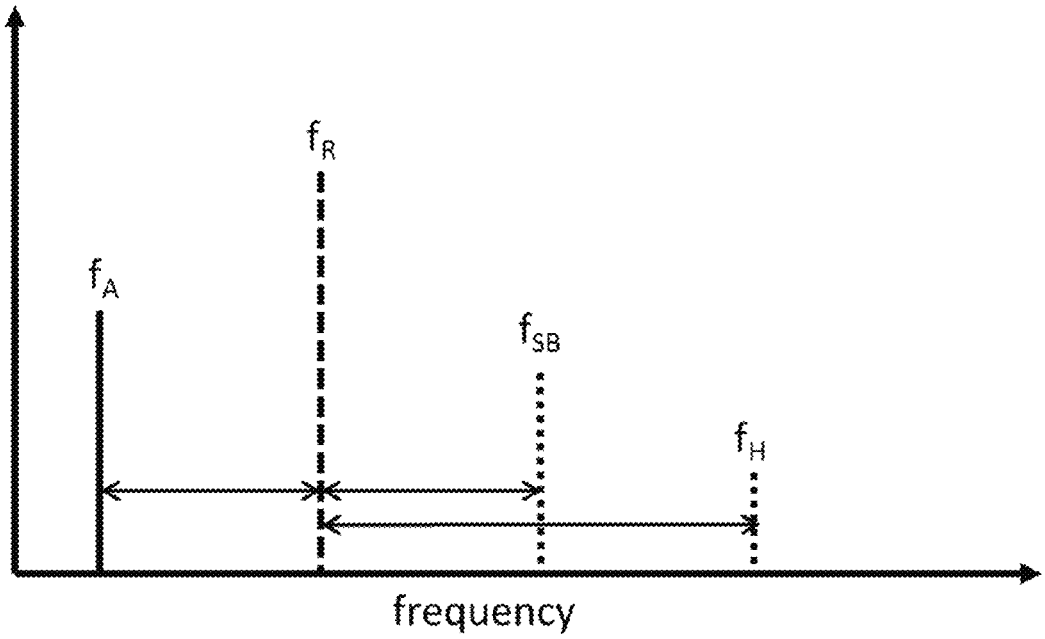
FIG. 5B shows a schematic mass spectrum of reporter ion species R whose motion is modulated in amplitude by a single analyte ion species A. The mass spectrum comprises mass signals of the analyte and reporter ions species at frequencies $f_A$ and $f_R$, as well as sideband signals at frequencies $f_{SB}$ and $f_H$. The signal at frequency $f_H$ is generated due to higher frequency components present in the modulating function.

FIG. 5B shows a schematic mass spectrum of reporter ion species R whose motion is modulated in amplitude by a single analyte ion species A. The mass spectrum comprises mass signals of the analyte and reporter ions species at frequencies $f_A$ and $f_R$ as well as sideband signals at frequencies $f_{SB}$ and $f_H$. If the modulating function is a single sine wave with frequency $f_M$, sideband signals are generated at frequencies $f_{SB}=f_R\pm f_M$.

Since the modulating function is periodic, but typically not a pure sine wave, the modulating function also comprises frequency components at frequencies $2\cdot f_M$, $3\cdot f_M$, $4\cdot f_M$ . . . , wherein the amplitudes of the higher frequency components are given by the Fourier series analysis. These frequency components generate additional sideband signals: $f_{SB}=f_R\pm n\cdot f_M$, with n=2, 3, 4 . . . . The sideband signal $f_H$ relates to n=2. The sideband signals for n>2 enable determining mass signals of the analyte ions at higher resolution compared to mass signals at the fundamental frequencies, because the spacing of two sideband signals is n times higher than the spacing of the two corresponding fundamental frequencies.

Figure 6:
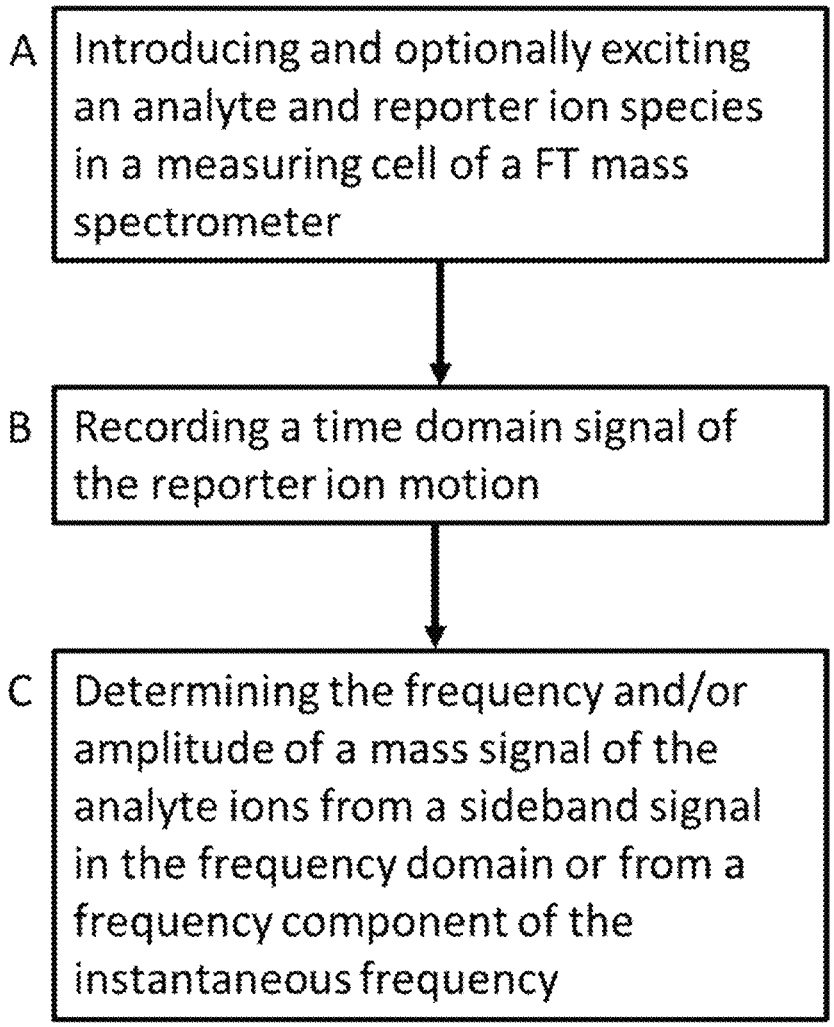
FIG. 6 shows a flow chart of a method according to the first aspect of the invention.

FIG. 6 shows a flow chart of a method according to a first aspect of the invention. In step (A), an analyte and reporter ion species are introduced and optionally excited in a measuring cell of a FT mass spectrometer. In step (B), a time-domain signal of the reporter ion motion is recorded. In step (C), the frequency and/or the amplitude of a mass signal of the analyte ion species are determined from a sideband signal of the reporter ions in the frequency domain or from the instantaneous frequency of the reporter ions in the time domain.

Figure 7:
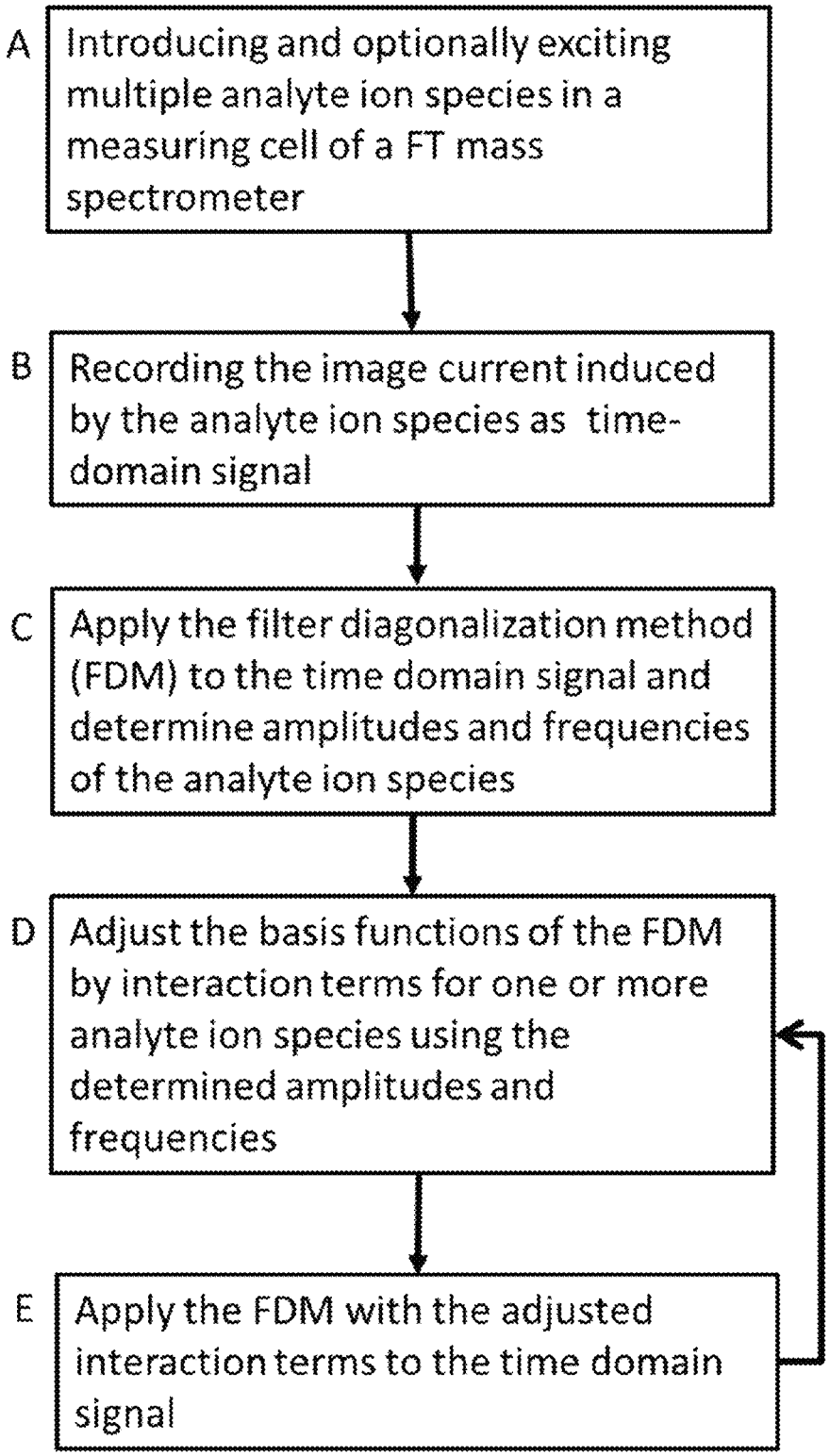
FIG. 7 shows a flow chart of a method according to the second aspect of the invention.

FIG. 7 flow a flow chart of a method according to the second aspect of the invention. In step (A), multiple analyte ion species are introduced and optionally excited in a measuring cell of a FT spectrometer. In step (B), the image current induced by the analyte ion species is recorded as a time-domain signal. In step (C), the filter diagonalization method (FDM) is applied to the time-domain signal and amplitudes and frequencies of the analyte ion species are determined. In step (D), the basis functions of the FDM are adjusted by interaction terms for one or more analyte ion species using the determined amplitudes and frequencies. In step (E), the filter diagonalization method with the adjusted interaction terms (FDM) is applied to the time-domain signal. Optionally, steps (D) and (E) are be repeated.

Although the present invention has been illustrated and described with respect to several preferred embodiments thereof, various changes, omissions and additions to the form and detail thereof may be made therein, without departing from the spirit and scope of the invention.

The invention claimed is:

1. A method for acquiring a mass spectrum of analyte ions with a Fourier transform mass spectrometer, comprising the steps of:

providing the analyte ions and at least one reporter ion in a measuring cell wherein the analyte ions and the at least one reporter ion oscillate at mass specific frequencies in the measuring cell and interact by coulomb forces;

recording a time domain signal of the reporter ion motion; and determining a mass signal of the analyte ions from a sideband signal of the at least one reporter ion in the frequency domain or from the instantaneous frequency of the at least one reporter ion in the time domain, wherein the interaction between the analyte ions and the reporter ion periodically modulates the reporter ion motion in time and generates the sideband signal in addition to the fundamental signal of the reporter ion in the frequency domain.

2. The method of claim 1, wherein the reporter ion motion is modulated in phase, frequency and/or amplitude.

3. The method of claim 1, wherein the frequency $f_A$ of an analyte mass signal is determined by subtracting the frequency $f_{SB1}$ of a first sideband signal of the reporter ion from two times the fundamental frequency of the reporter ion $f_R$.

4. The method of claim 1, wherein the reporter ion motion is modulated in frequency, the instantaneous frequency of the reporter ion is determined from a time-frequency representation of the recorded time-domain signal and the frequency $f_A$ is determined from a spectral decomposition of the instantaneous frequency.

5. The method according to claim 1, wherein the time-domain signal is recorded as a transient of an image current induced by the reporter ion on detection electrodes of the measuring cell.

6. The method according to claim 1, wherein the reporter ion comprises an optically detectable moiety and the motion of the reporter ion is recorded by optical means.

7. The method according to claim 1, wherein the FT mass spectrometer is one of an ion cyclotron resonance mass spectrometer, an electrostatic Kingdon ion trap with a harmonic potential along a longitudinal direction and an RF-ion trap.

8. The method according to claim 7, wherein the FT mass spectrometer is an ion cyclotron resonance mass spectrometer and the analyte ions and the reporter ion are first introduced into an ICR cell of the spectrometer and then excited to a cyclotron orbit of substantially the same radius.

9. The method according to claim 7, wherein the FT mass spectrometer is an orbital Kingdon ion trap and wherein the analyte ions and the reporter ion are introduced into the orbital Kingdon ion trap such that the analyte ions and the reporter ion orbit around a central electrode at substantially the same radius while oscillating in the longitudinal direction in the harmonic potential.

10. The method according to claim 1, wherein the analyte ions comprise multiple ion species with different mass-to-charge ratios.

11. The method according to claim 10, wherein the mass specific frequency of the reporter ion is lower than the mass specific frequencies of the analyte ions.

12. The method according to claim 10, wherein the mass specific frequency of the reporter ion is higher than the mass specific frequencies of the analyte ions.

13. The method according to claim 1, wherein the recorded time-domain signal is a superposition of the time-domain signal of the analyte ions and the reporter ion.

14. A parameter estimation method for determining frequencies and amplitudes of analyte ion species in a time-domain signal acquired with a Fourier transform mass spectrometer, wherein basis functions used in the parameter estimation method comprise at least one interaction term which incorporates a modulation of the time-domain signal of the analyte ion species wherein the modulation is a result of a Coulomb interaction between the analyte ion species while the time-domain signal is acquired.

15. The method according to claim 14, wherein an instantaneous frequency of a time-domain signal of at least one analyte ion species is determined from a time-frequency representation of the time-domain signal and tested to determine whether a modulation is present, and wherein a known modulation is used to adjust the at least one interaction term.

16. The method according to claim 14, wherein the acquired time-domain signal comprises a time-domain signal of at least one reporter ion and wherein the frequency-domain signal of the at least one reporter ion is tested for the presence of sideband signals and wherein the sideband signals are used to adjust the at least one interaction term.

17. The method according to claim 14, wherein the at least one interaction term is iteratively adjusted.

18. The method according to claim 17, wherein the parameter estimation method is at first applied to the time-domain signal with basis functions which do not comprise any interaction terms and wherein the determined frequencies and amplitudes of analyte ion species are used to adjust the at least an interaction term for a subsequent parameter estimation.

19. The method according to claim 14, wherein the parameter estimation method is one of linear prediction, the Prony method and the filter diagonalization method.

* * * * *